US005133645A

United States Patent [19]

Crowley et al.

[11] Patent Number: 5,133,645

[45] Date of Patent: Jul. 28, 1992

[54] COMMON RAIL FUEL INJECTION SYSTEM

[75] Inventors: Patrick J. Crowley, Grand Rapids; Richard L. Hilsbos, Bellevue; Harold L. Wieland, Jenison; Robert D. Straub, Lowell; Richard F. Teerman, Wyoming; Robert C. Timmer, Grandville, all of Mich.

[73] Assignee: Diesel Technology Corporation, Grand Rapids, Mich.

[21] Appl. No.: 553,523

[22] Filed: Jul. 16, 1990

[51] Int. Cl.[5] ..... F04B 19/02; F02M 54/36

[52] U.S. Cl. ..... 417/279; 417/282; 417/493; 123/447; 123/456

[58] Field of Search ..... 417/279, 282, 295, 303, 417/493, 503; 123/446, 447, 456, 506

[56] References Cited

U.S. PATENT DOCUMENTS

| | | | |
|---|---|---|---|
| 1,849,490 | 3/1932 | Junkers . | |
| 2,192,372 | 3/1940 | Buckwalter | 103/41 |
| 2,410,517 | 11/1946 | Muller . | |
| 2,582,535 | 1/1952 | Drouot | 417/493 |
| 2,871,796 | 2/1959 | Dreisin et al. | 103/154 |
| 3,027,843 | 4/1963 | Raibaud | 103/41 |
| 3,392,715 | 7/1968 | Thoma | 123/139 |
| 3,545,896 | 12/1970 | Zahradnik | 417/493 |
| 3,630,643 | 12/1971 | Eheim et al. | 417/282 |
| 4,064,845 | 12/1977 | Bart | 123/32 |
| 4,068,640 | 1/1978 | Watson et al. | 123/139 AT |
| 4,089,315 | 5/1978 | Lakra | 123/139 AK |
| 4,426,198 | 1/1984 | Bastenhof et al. | 417/494 |
| 4,505,243 | 3/1985 | Miwa | 123/446 |
| 4,539,956 | 9/1985 | Hengel et al. | 123/357 |
| 4,579,096 | 4/1986 | Kobayashi et al. | 123/299 |
| 4,590,904 | 5/1986 | Wannenwetsch | 123/300 |
| 4,603,671 | 8/1986 | Yoshinaga et al. | 123/467 |
| 4,633,837 | 1/1987 | Babitzka | 123/446 |
| 4,667,638 | 5/1987 | Tgashira et al. | 123/446 |
| 4,671,232 | 6/1987 | Stumpp et al. | 123/300 |
| 4,674,448 | 6/1987 | Steiger | 123/446 |
| 4,696,271 | 9/1987 | LeBlanc | 123/299 |
| 4,881,504 | 11/1989 | Best | 123/447 |
| 5,005,548 | 4/1991 | Rembold | 123/447 |

FOREIGN PATENT DOCUMENTS

| | | | |
|---|---|---|---|
| 2122695 | 1/1984 | United Kingdom | 123/447 |

OTHER PUBLICATIONS

*Diesel Locomotives-Mechanical Equipment*, Article-Cooper-Bessemer Fuel Pump, pp. 59-62.

SAE Paper No. 770084 entitled "UFIS—A New Diesel Injection System" By: J. A. Kimberley and R. A. DiDomenico.

SAE Paper No. 810258 entitled "Electronic Fuel Injection Equipment for Controlled Combustion in Diesel Engines", By: R. K. Cross et al.

SAE Paper No. 840513 entitled "Kompics On A High Bmep Engine" By: K. Komiyama et al.

*Primary Examiner*—Richard A. Bertsch
*Assistant Examiner*—David L. Cavanaugh
*Attorney, Agent, or Firm*—Brooks & Kushman

[57] ABSTRACT

A common rail fuel system is described which consists primarily of a high-pressure fuel pump, nozzles and a rail or rails having a substantially constant rail pressure situated between the fuel pump and the nozzles, the necessary connecting fuel lines and electronic control system. The pump is constructed to add leakage fuel to each stroke output without the necessity for routing this leakage fuel through the primary supply. This reduces the total amount of fuel pumped and improves metering accuracy.

6 Claims, 4 Drawing Sheets

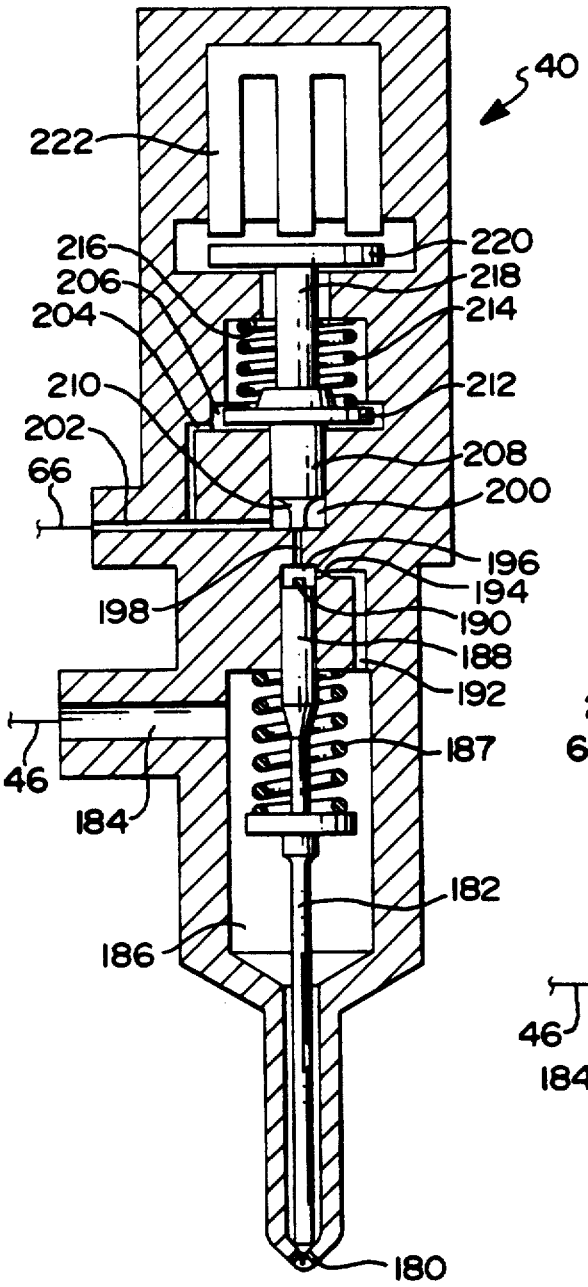
FIG 4
FIG 5
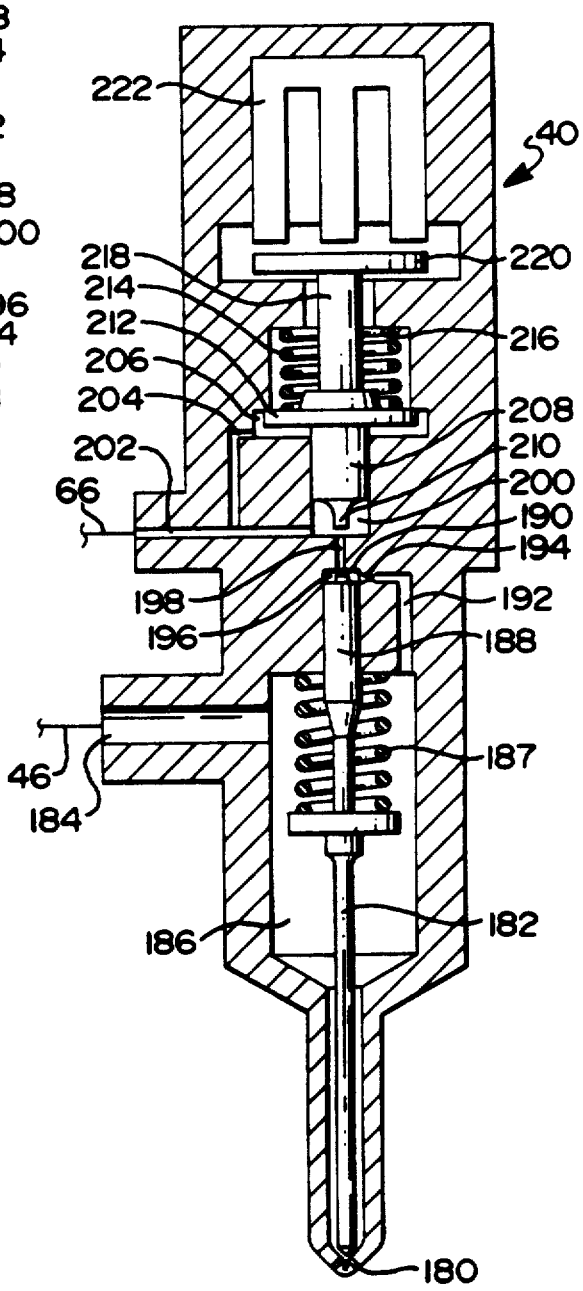

COMMON RAIL FUEL INJECTION SYSTEM

TECHNICAL FIELD

This invention relates generally to fuel injection systems for engines and, in particular, diesel engine applications.

BACKGROUND

Practically all fuel systems for diesel engines employ high-pressure pumps, the output volume of which is made variable by varying the effective displacement of the pump. Injection pressures of these systems generally are dependent upon speed and fuel output. At lower engine speeds and fuel outputs injection pressure falls off producing less than an optimum fuel injection process for good combustion.

SUMMARY OF THE INVENTION

The common rail fuel system consists primarily of a high-pressure fixed displacement fuel pump, nozzles, a rail or rails having relatively constant pressure situated between the fuel pump and the nozzles, the necessary connecting fuel lines, and an electronic control system.

Electronic controls technology makes the system of this invention possible. A fixed displacement pump controls the fuel flow to the engine and increases the pressure and volume of the fuel as required for optimum combustion. Injection pressure is controlled by electronically controlled nozzles which determine the duration of injection. Injection pressure can be varied by varying the on time of the nozzle solenoid while the output of the pump is held constant.

The inlet valve of the high-pressure pump is a metering valve which is actuated by a solenoid. The electrical pulse to the solenoid is supplied by the electronic control system, which is also responsible for matching of the metered fuel volume to the fuel volume required for the engine operating conditions. The electronic control system determines the beginning and end of the electronic pulse sent to the solenoid stator which actuates the metering inlet valve. System characteristics determine the armature and valve assembly response. Correlation of the duration of the solenoid activation pulse to the fuel requirement of the engine is established by a fuel map developed through test and programmed into the controller.

The relative constant pressure supply fuel is boosted to injection pressure by the high-pressure fuel pump. Fuel volume is metered by the inlet valves. The inlet valve is actuated by a solenoid and opens shortly after the plunger begins the retraction stroke. Fuel at supply pressure flows in to fill the cavity produced by the retracting plunger. When the proper volume of fuel to supply one cylinder firing event for the load and speed conditions present at the time has been admitted to the pumping chamber, the inlet valve closes. Plunger travel during the time the inlet valve is held open determines the volume displaced by the plunger and, therefore, the volume of fuel admitted to the high-pressure chamber of the pump.

As the plunger continues to retract after closing of the inlet valve, a vacuum is created in the pumping chamber. Near the end of the plunger retraction stroke, the leakage return port is uncovered. The vacuum in the pumping chamber increases the pressure differential between the leakage system and the pumping chamber, improving fuel flow from the leakage system into the pumping chamber. Once equilibrium of the leakage system has been achieved, the volume of leakage system fuel which is held in the pumping chamber is equal to the leakage of the plunger and nozzle(s) during one pumping and retraction cycle of the plunger.

At the start of the pumping stroke, the leakage return port is uncovered. A check valve may be placed in the leakage return line to prevent fuel from escaping until the port is closed by the upward moving plunger. Otherwise the pump output will be reduced by the volume of fuel which escaped. Pressure will begin to increase in the pumping chamber as soon as the plunger begins to rise if a check valve is used. If no check valve is placed in the leakage return line to prevent fuel from flowing out of the leakage return port, pressure will begin to increase when the port is closed by the upward moving plunger. The rate of increase is a function of volume of fuel trapped in the pumping chamber and bulk modulus of the fuel. When the fuel inside the pumping chamber reaches a pressure adequate to overcome the force of rail pressure on the delivery valve, and any spring load, if a spring is used, the delivery valve opens and fuel flows from the pumping chamber into the rail. Fuel continues to flow from the pumping chamber into the rail until the plunger direction again reverses and the plunger begins to retract, increasing pumping chamber volume and reducing pressure in the pumping chamber. The rail pressure, assisted by the spring load, if present, closes the delivery valve.

Steady-state rail pressure and pump output are maintained by controlling the relative on duration of the fuel pump inlet solenoid and the nozzle solenoid signal duration, and are controlled by the ECM. During engine start-up, fuel pump inlet solenoid signal duration is maximized until rail pressure is attained. Once the engine is started, solenoid signal durations are adjusted by the ECM to maintain the desired speed as determined by throttle position.

Introduction of the fuel from the pumping chamber into the rail produces a short-term pressure increase in the rail. This pressure pulse is superimposed on the steady-state pressure maintained in the rail. Rail and connecting line design are intended to minimize the disturbance created by this pulse.

Pulses are created by the opening and closing of the injection valve in the nozzle. These pulses can be phased relative to the pulses generated by the pump by advancing or retarding the pump with respect to the nozzle to achieve the most favorable interaction between pump and nozzle pulses. Nozzle event timing is controlled only by combustion factors.

Rail pressure can be maintained relatively constant, varying only by the fluctuations due to the output pulses of the pump and the injection pulses. These fluctuations are small relative to injection pressure, being attenuated by the elasticity of the reservoir structure and volume of high-pressure fuel. Rail pressure is also independent of speed.

The common rail system of the invention provides the advantage that fuel at injection pressure is available at the nozzle immediately upon opening of the valve in the tip of the nozzle and the opportunity to maintain a more advantageous spray pattern throughout a wider engine speed and load range.

These and other features of the invention will be more fully understood from the following description of the preferred embodiment taken together with the accompany drawings.

BRIEF DESCRIPTION OF THE DRAWINGS

FIG. 4 is a sectional view showing one of the injector nozzles of the common rail system, with the nozzle being shown in closed position;

FIG. 5 is a view similar to FIG. 4 with the nozzle shown in the open position under actuation by the nozzle solenoid.

DETAILED DESCRIPTION OF THE INVENTION

Figure 1:
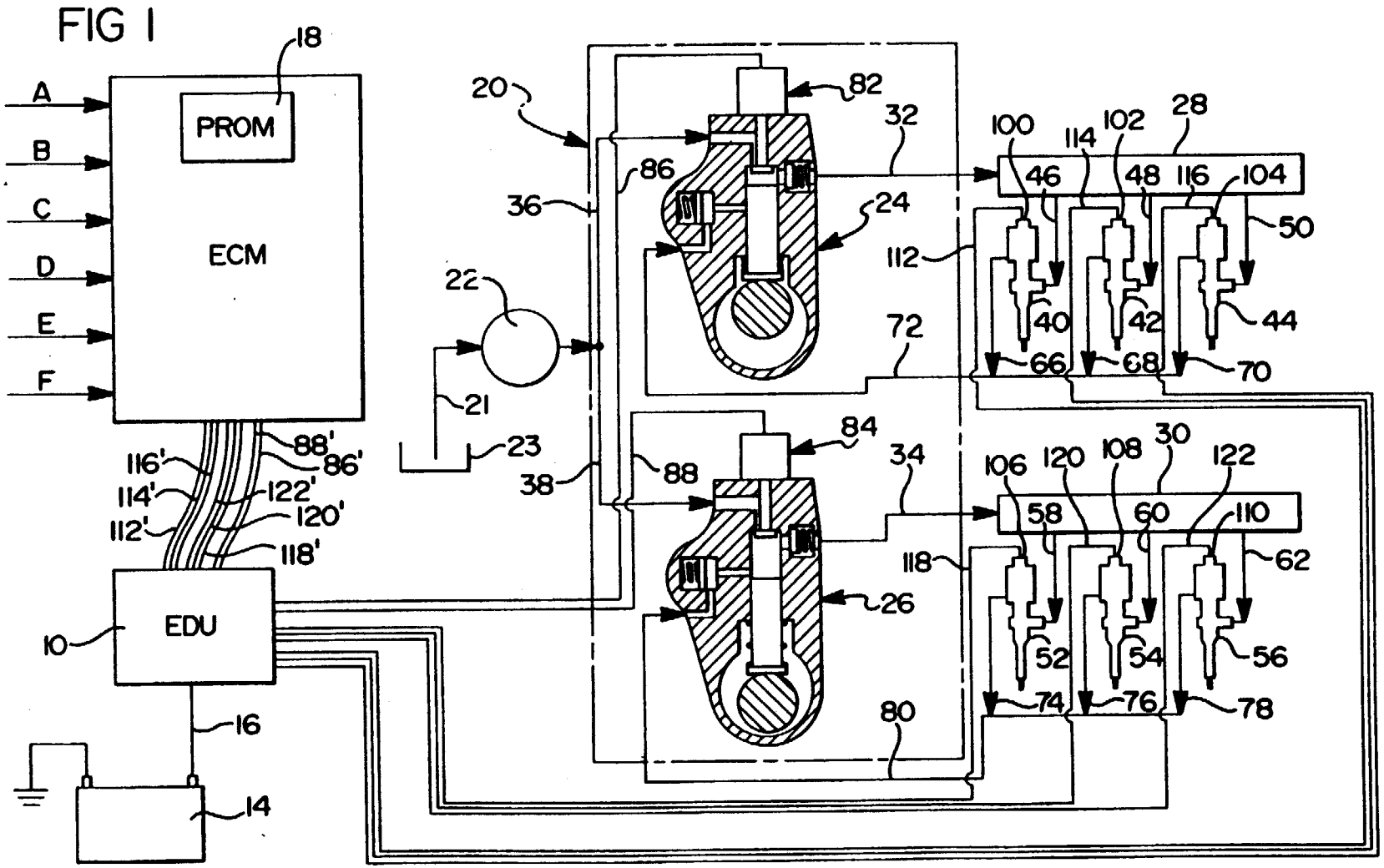
FIG. 1 is a schematic showing the fuel system of the invention.

Referring to FIG. 1, there is shown the common fuel rail system of the invention as applied to a six-cylinder diesel engine. The system includes an electronic control module 10 (ECM) which sends signals to an electronic distribution unit 12 (EDU). As is usual, the signals are of low voltage and low power and activate the electronic distribution unit which is connected to a 12-volt vehicle battery 14 by a conductor 16. The ECM has at least two electronic inputs, one input A which indicates crank shaft position as a timing reference. The other output B indicates throttle position as a load reference. Optional inputs are C—turbo boost, D—temperature of oil, E—coolant level, and F—oil pressure. The ECM also has a PROM 18 which is programmed by a fuel map developed by actual engine testing.

The system further includes a fuel-injection pump assembly which is supplied with fuel by a fuel supply pump 22 connected by a line 21 to a fuel tank 23. Pump assembly 20 includes two high-pressure fuel-injection pumps 24 and 26, with pump 24 supplying the high-pressure common fuel rail 28, while pump 26 supplies the high-pressure common fuel rail 30 through supply lines 32 and 34, respectively. Lines 36 and 38 supply fuel at constant pressure to the high-pressure fuel-injection pumps 24 and 26 from the supply pump 22. The high-pressure fuel rail 28 supplies fuel to the injection nozzles 40, 42 and 44 by way of lines 46, 48 and 50, while the high-pressure fuel rail 30 supplies injection nozzles 52, 54 and 56 by way of lines 58, 60 and 62, respectively.

Some leakage occurs at the nozzles which is captured by the nozzle leakage return lines 66, 68 and 70, which feed the nozzle leakage return line 72, while the nozzle leakage return lines 74, 76 and 78 feed the nozzle leakage return line 80. The pumps have solenoid valves 82 and 84, respectively, which connect through conductors 86 and 88, respectively, to the EDU and are operated by signals the ECM received by way of conductors 86' and 88', respectively. The injector nozzles have solenoids 100, 102, 104, 106, 108 and 110 which are operated by the EDU by conductors 112, 114, 116, 118, 120 and 122, respectively, which are in turn controlled by signals sent from the ECM by conductors 112', 114', 116', 118', 120' and 122', respectively.

Figure 2:
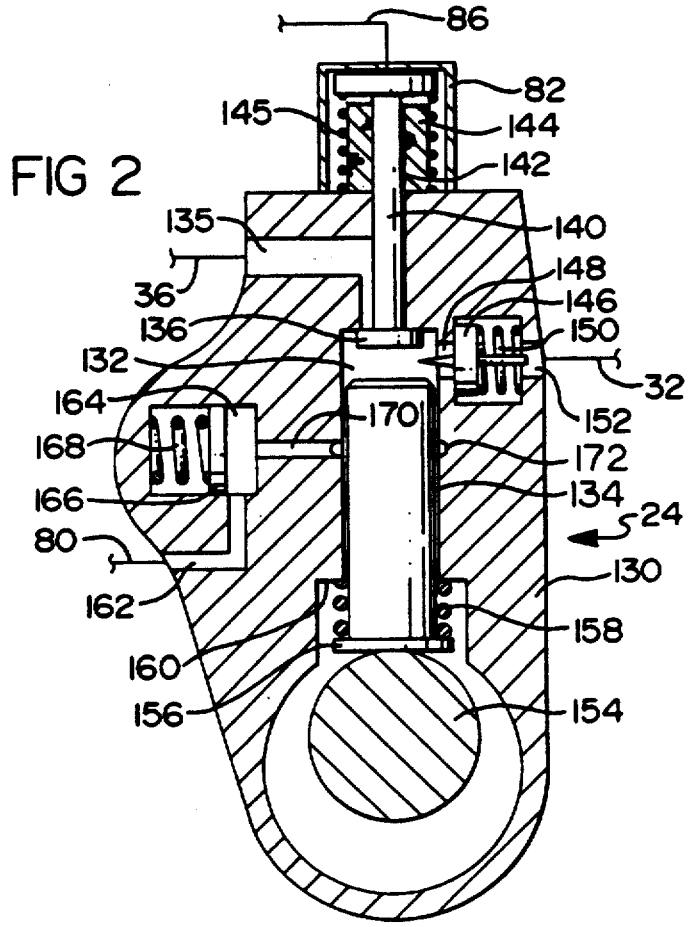
FIG. 2 is a sectional view showing the novel high-pressure pump used in the system.

FIG. 2 shows the details of construction of fixed displacement pump 24 which is identical to pump 26. Pump body 130 houses a pumping chamber 132 within which a pumping plunger 134 reciprocates between fixed top and bottom positions, as will be later described in reference to FIG. 3. Fuel is delivered to inlet port 135 of pump 24 by supply line 36. Flow of fuel into pumping ,chamber !32 is controlled by inlet valve 136 by fluctuations due to the output pulses of the pump. These fluctuations are small since they are attenuated by the elasticity of the rail structure and volume of high-press fuel. Rail pressure is independent of engine speed. Inlet valve 136 includes a stem 140 which mounts the armature 142 of solenoid 82. Armature is normally retracted within stator 144 by a compression spring 145, and is extensible upon energization of stator 144 via conductor 86 to open valve inlet port 135. The amount of fuel pumped by pump 24 is dependent upon the length of time solenoid 82 is energized and inlet valve 136 is open.

Fuel delivery from pump 24 is controlled by outlet valve 146 which opens to connect outlet passage 148 which is normally closed by a compression spring 150. Upon opening, valve 146 connects passage 148 with outlet port 152 to enable pressurized flow to delivery line 32.

Plunger 134 is reciprocated within chamber 132 by a rotating cam 154 between top and bottom positions, thus providing a constant volume pump. A bottom flange 156 is maintained in contact with cam 154 by a compression spring 158, confined between flange 156 and a pump body internal wall 160.

Leakage return line 80 is connected to a leakage fuel inlet port 162 in pump body 130 to deliver leakage fuel to a leakage accumulator chamber 164. Chamber 164 houses a piston 166 that is backed by a compression spring 168. Leakage fuel accumulated during a pumping cycle is delivered to chamber 132 through leakage chamber outlet passage 170, as will be later described. Any fuel leaking past plunger 134 during a cycle collects in a collector groove 172.

Operation of fuel pump 24 will now be described with reference to FIGS. 3A-3D which sequentially depict a pumping cycle.

Figure 3A:
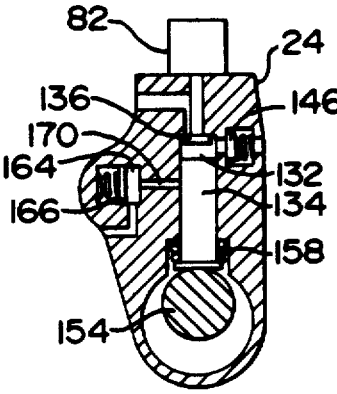
FIGS. 3A-G are sectional views illustrating the pump at six different sequential points in a cycle of operation.

Referring also to FIGS. 3A-3G, it is noted that the high-pressure pump shown in FIG. 2 is in the same position as the pump shown in FIG. 3A. In operation, the cycle starts when the plunger is just past top dead center (TDC) with the solenoid off and both the inlet valve 136 and outlet valve 146 are closed by respective springs 145 and 150.

Figure 3B:
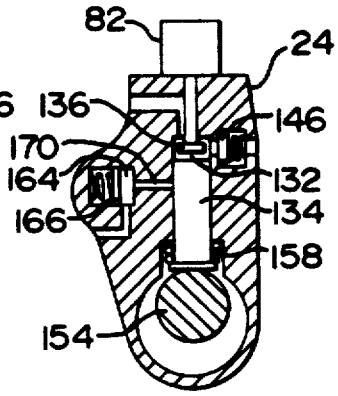
Figure 3C:
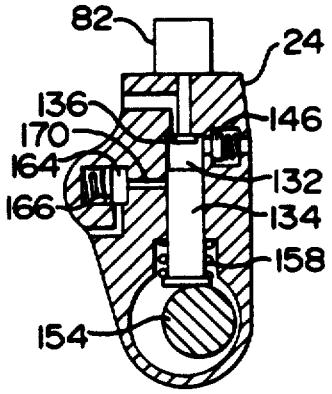

As shown in FIG. 3B, as cam 154 enables spring 158 to begin retracting plunger 134, the inlet valve 136 is opened by the solenoid 82, permitting fuel to flow into the pumping chamber 132. Upon further rotation of the cam 154 and passage of a predetermined period of time, shown in FIG. 3C, the inlet valve 136 is closed by the solenoid 82, halting fuel flow to the pumping chamber 132. The length of time that inlet valve 136 is held open determines how much fuel is metered into the pumping chamber 132.

Figure 3D:
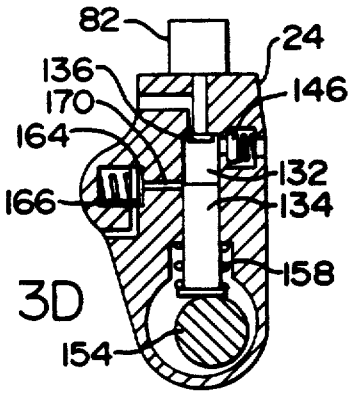
Figure 3E:
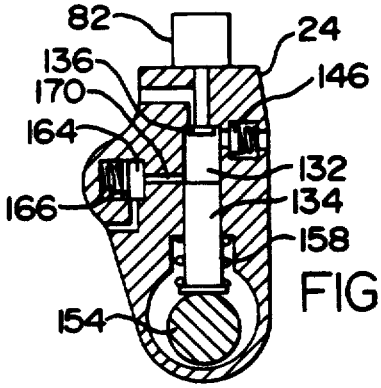
Figure 3F:
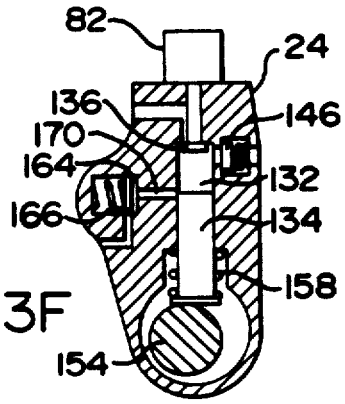

As shown in FIG. 3D, further cam rotation effects plunger retraction, with no additional fuel being metered into the pumping chamber. This creates a sub-atmospheric pressure, or partial vacuum, in chamber 132.

One feature of the invention is that fuel accumulated from nozzle and/or plunger leakage is returned to the high-pressure pump without passing through the primary metering valve 136. As the cam 154 reaches its bottom dead center (BDC) position (FIG. 3E), final retraction of the plunger 134 opens the passage 170 to connect the fuel leakage accumulator chamber 164 with the pumping chamber 132. The rear of the chamber 164 is maintained at atmospheric pressure to enable the portion of the chamber in front of piston 166 to expand upon pressurization by leakage fuel and serve as an accumulator. Many alternate forms of accumulators could also be utilized, including elastic lines, diaphragms, or compressed volume. The force of the spring 168 biasing piston 166 and the sub-atmospheric pressure in chamber 164 combine to force the leakage fuel accumulated during the previous engine cycle (i.e., since the last stroke of pump 24) into the pumping chamber 132.

Figure 3G:
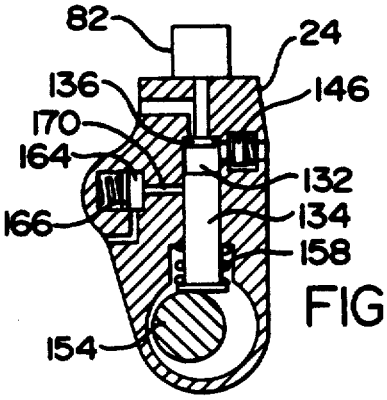

Rotation of the cam 154 past BDC (FIG. 3F) strokes the plunger 134 upwardly, closing passage 170 and pressurizing the chamber 132 from sub-atmospheric to super-atmospheric pressures. As the pressure in the chamber 132 rises, any leakage past the plunger 134 will collect in an annular collector groove 172 and enter the leakage accumulator chamber 164 through the passage 170. As shown in FIG. 3G, after the leakage return port is closed, continued upward motion of the plunger 134 pressurizes the fuel until the outlet valve 146 opens. The outlet valve 146 remains open until the plunger 134 reaches TDC and begins a new cycle.

It is apparent that the quantity of fuel injected on each stroke of the plunger 134 depends on the duration of opening of inlet valve 136 which is controlled by the solenoid 82. Since operation of the solenoid 82 can be precisely controlled, the quantity of fuel pumped can likewise be precisely controlled.

As a safety feature, it is understood that any break in the electrical conductors connecting to the solenoids 82 and 84 will stop fuel delivery to the injectors served by the particular high-pressure pump.

The fuel injection nozzles 40–44, 52–56 for the common rail fuel injection system are electronically controlled solenoid valves having spray holes which convert the rail pressure head to velocity in the injection plume. As shown in FIG. 1, pressurized fuel is supplied by the high-pressure pumps 24, 26 and stored in the rails 28, 30, or distribution system, which serves as a fuel accumulator. FIGS. 4 and 5 show one of the nozzles 40 in the, closed (between injections) and open (during injection) positions, respectively.

Injector nozzle 40 injects precise amounts of fuel into an engine combustion chamber (not shown) through spray holes 180 as regulated by a pilot-controlled metering valve 182. Pressurized fuel is delivered from rail 28 through delivery line 46 through inlet port 184 to a chamber 186 housing valve 182, which is biased to its normally-closed FIG. 4 position by a compression spring 187.

Metering valve 182 has a stem 188 which terminates in a throttling stop 190. Chamber 186 connects through a passage 192 and an orifice 194 to a pilot chamber 196 atop valve stem 188. Chamber 196 connects through a passage 198 to a chamber 200 which connects through a passage 202 to fuel return line 66. Another passage 204 connects passage 202 with an annular chamber 206.

A solenoid-controlled pilot valve 208 has a nose 210, which valves passage 198, and an annular shoulder 212 which confines a spring 214 between it and a housing land 216, biasing valve 208 downwardly to close passage 198. Valve 208 includes a stem 218 that mounts a discoid solenoid armature 220 adjacent a solenoid stator 222. Operation of injector 40 will now be described.

With the injection valve 182 closed (FIG. 4), pressurized fuel from the rail 28 flows via line 46 to the nozzle inlet passage 184. Chamber 186 is at rail pressure. In this condition, the solenoid stator 222 is deenergized and the pilot valve 208 is closed by spring 214. With valve 208 closed, there is no flow through passage 198, permitting the fuel in chamber 196 to reach a pressure equal to the pressure in chamber 186, which is rail pressure. With the pressures in the two chambers equal, valve 182 is pressure balanced. The force of the spring 187 acting on valve 182 aids in closing the valve, but is used primarily to keep the valve seated against combustion chamber pressure. Passages 184, 192 and 198 and chambers 186 and 196 are all at rail pressure, and there is no flow through the system.

To begin injection, solenoid stator 222 is energized, attracting armature 220 toward stator 222 and lifting nose 210 of valve 208 from its seat to open passage 198. FIG. 5 shows the nozzle in the valve open condition during injection. With valve nose 210 unseated, flow starts through passage 198, reducing the pressure in chamber 196. Orifice 194, through which fuel from chamber 186 replaces the fuel leaving chamber 196, restricts the flow to create a pressure drop between chambers 186 and 196. With the pressure in chamber 196 less than that in chamber 186, valve 182 becomes pressure unbalanced. The pressure imbalance overcomes the force of spring 187 and lifts valve 182 from its seat, enabling pressurized fuel to be ejected through the spray holes 180 and starting fuel injection to the combustion chamber. The throttling stop 190 at the end of valve 182 throttles flow into passage 198, while permitting adequate fuel flow through orifice 194 and passage 198 to maintain the pressure imbalance and keep valve 182 open. Passages 202 and 204 are provided to drain leakage past valve 208 to the fuel leakage return system via line 66.

When solenoid stator 222 is deenergized to end fuel injection into the combustion chamber, spring 214 seats valve 182, stopping flow through passage 198. Pressure in chamber 196 increases until the combined force of rail pressure and spring 187 overcome the opposing force caused by combustion pressure and valve 182 closes. Fuel can now no longer flow to the spray holes and injection ends.

Figure 6:
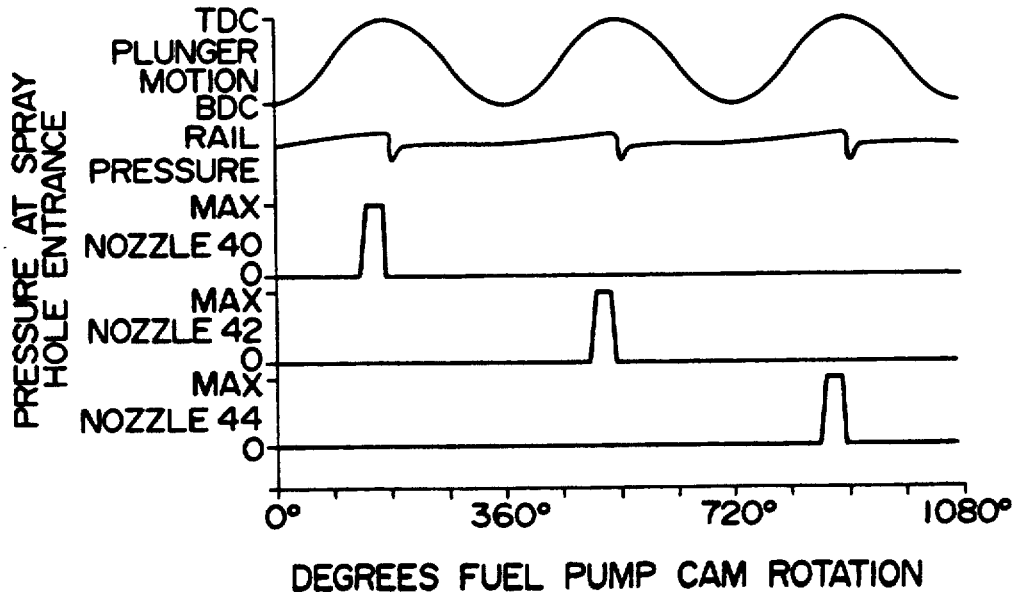
FIG. 6 is a graph illustrating the pressure at the spray hole entrance, shown at the various degrees of fuel pump cam rotation when the discharge of the various nozzles takes place and shows the slight variation in rail pressure during discharge.

FIG. 6 is a graph showing the pressure at the spray hole entrance of the nozzles 40, 42 and 44 according to degrees of fuel pump cam rotation. It also shows the rail pressure being maintained relatively constant, varying only by fluctuations due to the output pulses of the pump. These fluctuations are small since they are attenuated by the elasticity of the rail structure and volume of high-pressure fuel. Rail pressure is independent of engine speed.

While the best mode for carrying out the invention has been described in detail, those familiar with the art to which this invention relates will recognize various alternative designs and embodiments for practicing the invention as defined by the following claims.

We claim:

1. A high-pressure pump for the injectors of an electronically controlled fuel system comprising: a pump body having a chamber therein, a reciprocal plunger in said chamber having a fixed stroke, a solenoid operated normally closed metering inlet valve for metering fuel into said chamber, a normally closed discharge valve, both of said valves being located within said pump body and closing respective fuel ports communicating with said chamber at one end of said plunger and means for controlling the amount of fuel discharged by said pump comprising an electronic control for said solenoid-operated valve to determine the time that said valve is held open during the intake stroke of said plunger;

a supply pump for delivering fuel at a relatively fixed pressure to said metering inlet valve; and said pump having a port in a side wall of the chamber in which the plunger reciprocates, said port being adjacent bottom dead center of said reciprocating plunger and being connected to the leakage passages of said injectors whereby the leakage of said injectors in said pump is discharged through said discharge valve together with the fuel coming from said metering intake valve.

2. A high-pressure pump for an electronically controlled fuel-injection system comprising: a pump body having a chamber therein, a mechanically driven reciprocating plunger in said chamber and having a fixed stroke, said chamber extending slightly past the top dead center of said plunger, an intake poppet valve at the end of said chamber and facing said plunger for admitting fuel to said chamber, a solenoid coil at said end of said chamber, said intake valve serving as a metering valve and having a stem extending through the solenoid coil and having an armature portion at the end thereof, spring means biasing said intake valve to closed position, said solenoid coil serving to open said valve when energized permitting fuel to flow into the chamber, a discharge valve adjacent said intake valve and communicating with said chamber when in an open position, said discharge valve being spring-biased toward closed position, means for delivering fuel at constant pressure to said intake valve means, and means for controlling the quantity of fuel on each delivery stroke of said valve comprising an electronic control mechanism to determine when said intake valve is opened and closed during the intake stroke of the plunger.

3. A high-pressure pump for use with an electronically controlled fuel-injection system comprising: a pump body and a mechanically driven reciprocating plunger in a chamber therein, said plunger having a fixed stroke, a solenoid-operated normally closed intake valve at one end of said chamber adjacent one end of said plunger, said intake valve having a single valve seat and allowing fuel to flow directly from the inlet port of said pump body directly to said chamber, a normally closed discharge valve at the same end of said chamber, and means for determining the quantity of fuel to be pumped on each stroke of the plunger comprising an electronic control for the solenoid to determine the timing of opening and closing of said intake valve.

4. A fuel system comprising: a common fuel rail with several solenoid-actuated fuel-injecting nozzles connected thereto, said fuel rail being connected to a high-pressure pump, means for supplying a fuel at a constant pressure to said pump, said pump including a reciprocating plunger of fixed stroke and a chamber for said reciprocating plunger providing a small space at the top dead center end of said plunger for the reception of a normally closed solenoid-operated intake metering poppet valve, a normally closed discharge valve communicating with said space and said rail, a port opening into said plunger chamber at approximately bottom dead center, said port being closed by said plunger until said plunger approaches bottom dead center, said port being connected to said nozzles to recover fuel leakage therefrom, as well as fuel leakage past the plunger of said pump, and electronic control means for determining the quantity of fluid to be pumped on each stroke of said plunger comprising means for controlling the time of opening and closing of said solenoid intake valve, said intake valve being opened at approximately top dead center of the plunger and being closed prior to reaching bottom dead center on the intake stroke of the plunger, said valve delivering fuel on the exhaust stroke of the plunger through the delivery valve to the nozzles and means for reciprocating the plunger.

5. A fuel system as in claim 4, wherein said pump has an accumulator exposed to the nozzle fuel leakage and serving to store fuel leakage for remetering independent of the metering of the primary fuel quantity.

6. A high-pressure constant-volume fuel pump for a fuel injection system, comprising a pump body having a pumping chamber, a pumping plunger reciprocal in said chamber, an inlet valve at one end of said chamber, a normally-closed outlet valve adjacent said inlet valve, means for cyclically reciprocating the plunger through a fixed stroke between top and bottom positions, control means for effecting inlet valve opening near the top of the plunger stroke to inlet fuel to the chamber for a selectively variable time period during the plunger downward stroke, and collecting means for collecting leakage fuel during a cycle located adjacent the other end of said chamber for connection to said chamber by movement of the plunger to its bottom position, whereby, after closing of the inlet valve during the downward stroke of the plunger, subsequent downward movement of the plunger so reduces chamber pressure that subsequent connection of the collecting means causes leakage fuel to enter the chamber for subsequent discharge with the inlet fuel from the pump upon opening of the outlet valve.

* * * * *

UNITED STATES PATENT AND TRADEMARK OFFICE

CERTIFICATE OF CORRECTION

PATENT NO. : 5,133,645

DATED : July 28, 1992

INVENTOR(S) : Patrick J. Crowley et al

It is certified that error appears in the above-identified patent and that said Letters Patent is hereby corrected as shown below:

On the Title page, item [56]:

Insert the following references:

| | | |
|---|---|---|
| 4,491,111 | 1/1985 | Eheim et al |
| 4,767,288 | 8/1988 | Straubel |
| 2,108,214 | 4/1983 | Great Britain |

Column 4, lines 8-12, delete "by fluctuations due to the output pulses of the pump. These fluctuations are small since they are attenuated by the elasticity of the rail structure and volume of high-press fuel. Rail pressure is independent of engine speed."

Signed and Sealed this

Twelfth Day of October, 1993

*Attest:*

*Attesting Officer*

Bruce Lehman

BRUCE LEHMAN

*Commissioner of Patents and Trademarks*